United States Patent [19]

Winston

[11] Patent Number: 4,599,009

[45] Date of Patent: Jul. 8, 1986

[54] PAINT ROLLER SEALING SYSTEM

[75] Inventor: Walter E. Winston, Carmel, Ind.

[73] Assignee: Black & Decker Inc., Newark, Del.

[21] Appl. No.: 623,321

[22] Filed: Jun. 22, 1984

[51] Int. Cl.[4] ..... B05C 17/02

[52] U.S. Cl. ..... 401/197; 401/208

[58] Field of Search ..... 401/197, 208, 188 R

[56] References Cited

U.S. PATENT DOCUMENTS

| | | | |
|---|---|---|---|
| Re. 29,311 | 7/1977 | Ritter . | |
| 860,078 | 7/1907 | Binks . | |
| 2,281,773 | 5/1942 | Kollmann . | |
| 2,478,318 | 8/1949 | Raub . | |
| 2,606,334 | 8/1952 | Vaden et al. . | |
| 2,627,620 | 2/1953 | Gudze | 401/197 |
| 2,743,469 | 5/1956 | Ditch . | |
| 2,751,618 | 6/1956 | Pruitt | 401/197 |
| 2,778,046 | 1/1957 | Fisher . | |
| 2,849,157 | 8/1958 | Remien, Jr. . | |
| 2,882,541 | 4/1959 | Easley | 401/197 |
| 2,965,911 | 12/1960 | Hempel et al. . | |
| 3,134,130 | 5/1964 | Chadwick, II . | |
| 3,230,570 | 1/1966 | Flippen . | |
| 3,231,115 | 1/1966 | Clark et al. . | |
| 3,457,017 | 7/1969 | Bastian . | |
| 3,539,268 | 11/1970 | Stebbins . | |
| 3,549,267 | 12/1970 | Wurzer et al. . | |
| 3,554,659 | 1/1971 | Stokes . | |
| 3,776,645 | 12/1973 | Walker . | |
| 3,826,581 | 7/1974 | Henderson . | |
| 3,877,823 | 4/1975 | Leland . | |
| 3,933,415 | 1/1976 | Woolpert . | |
| 4,072,429 | 2/1978 | Terzian et al. . | |
| 4,424,011 | 1/1984 | O'Brien et al. . | |

FOREIGN PATENT DOCUMENTS

| | | | |
|---|---|---|---|
| 665270 | 10/1965 | Belgium . | |
| 2511583 | 9/1976 | Fed. Rep. of Germany | 401/197 |
| 1035235 | 8/1953 | France . | |
| 1402540 | 5/1965 | France . | |
| 1451378 | 9/1966 | France | 401/197 |
| 2351714 | 12/1977 | France | 401/197 |

*Primary Examiner*—Steven A. Bratlie

*Attorney, Agent, or Firm*—Ronald B. Sherer; Harold Weinstein; Edward D. Murphy

[57] ABSTRACT

Described briefly, according to a typical embodiment of the invention, a roller has a core comprising plurality of relatively hard and rigid segments fastened together in a stack and rotatably mounted to a shaft. The roller core has internal baffled passageways established by grooves in abutting faces of segments, so that, when paint is supplied to a cavity in the center of the stack, it will depart through these passageways in the roller in a controlled manner. A diaphragm seal assembly is provided to prevent leakage of pressurized paint. A replaceable sock-like cover is received on the roller stack and secured by end retainers. The roller can be easily and completely disassembled for cleaning.

31 Claims, 8 Drawing Figures

PAINT ROLLER SEALING SYSTEM

BACKGROUND OF THE INVENTION

1. Field of the Invention

This invention relates generally to painting rollers, and more particularly to a roller having internal feed features useful with a pressurized supply.

2. Description of the Prior Art

Rollers for applying paint and other coating materials have been used for many years. Those most commonly used are dipped in paint (usually in a roller tray) and then applied to a wall or other surface to be coated.

Considerable effort has been directed toward rollers which need not be dipped. Some systems apply paint to the outside of the roller, otherwise than by dipping. Examples are found in U.S. patents as follows: U.S. Pat. No. 3,549,267, issued to Wurzer et al. on Dec. 22, 1970, and U.S. Pat. No. 4,072,429, issued to Terzian et al. on Feb. 7, 1978. An example is also shown in FIG. 8 of the Ritter patent mentioned below. It seems that most of the patents which have resulted from efforts to avoid dipping, disclose internally fed rollers. Examples are found in the following U.S. patents:

| Patent No. | Inventor | Date Issued |
|---|---|---|
| 2,743,469 | Ditch | 5/01/56 |
| 2,882,541 | Easley | 4/21/59 |
| 3,231,151 | Clark et al. | 1/25/66 |
| 3,457,017 | Bastian | 7/22/69 |
| 3,879,140 | Ritter | 4/22/75 |
| 3,933,415 | Woolpert | 1/20/76 |

The Ditch patent discloses a paint roller internally supplied through the handle tube. O-rings 16 mounted in the hubs 15 of the roller, seal the hubs to the tube.

The Easley roller is supplied through a roller mounting tube and through radially extending apertures in a wood, not-absorbent roller core. The paint is supplied to a roller cover made of wool or other material. The roller mounting tube is connected to a pressurized paint source. O-ring 23 in bearing sleeve 19 prevents leakage of paint outward between the bearings and tube.

The Clark et al. patent FIG. 3 discloses the use of a non-absorbent sleeve 74 mounted to the handle. It serves to occupy space in the roller and radially distribute paint from the handle tube or "conduit portion" 72. This is an effort to address the problem encountered in some prior art rollers where there is so much paint contained in the roller that the paint cannot be controlled by the cover and drips after the paint supply is shut off. The extra paint is also very heavy and tiresome for the operator to use. Such a problem might exist in the roller of FIG. 2 of the Ritter patent.

In the Woolpert patent, there are roller-type paint applicators in FIGS. 7, 8 and 9, the latter showing an edger in contrast to the cylindical rollers of FIGS. 7 and 8. In FIG. 8, there is shown a sponge roller 114 with a fitted fabric sleeve cover 130, all of which is mounted over a foraminous tube 110.

Some additional prior art specifically related to internally fed rollers, includes the following:

| Patent No. | Inventor | Date Issued |
|---|---|---|
| 860,078 | Binks | 7/16/07 |
| 2,606,334 | Vaden et al. | 8/12/52 |

-continued

| Patent No. | Inventor | Date Issued |
|---|---|---|
| 2,965,911 | Hempel et al. | 12/27/60 |
| 3,134,130 | Chadwick II | 5/26/64 |
| 3,539,268 | Stebbins | 11/10/70 |
| 3,554,659 | Stokes | 1/12/71 |
| 3,776,645 | Walker | 12/04/73 |
| 3,826,581 | Henderson | 7/30/74 |
| 3,887,823 | Leland | 4/15/75 |
| Re.29,311 | Ritter | 7/19/77 |

In the above patents, Binks provides a supply of paint to, and surplus removal from, the interior of a roller (FIG. 1), a pad (FIG. 3), and a brush (FIG. 5). Vaden discloses a plastic roller body with a sheepskin cover and threaded nut securing the cover to the roller. It has a delivery control valve push button 16 on the handle.

Hempel et al. discloses a polyurethane stationary wiper core in a self-contained inking roller. Chadwick shows a belt-type roller.

The Stebbins patent discloses a roller having a paint supply tube with an aperture centered longitudinally of the roller. The roller also has annular chambers 50 and 52 within a perforated rigid sleeve or cardboard tube 28 to which the fibers 32 are affixed.

Stokes shows one or two internally fed rollers mounted to paint supply spindles.

Walker shows roller-type applicators in FIGS. 5, 6, 9, 10 and 11, and also various types of pad applicators including pointed pads. Henderson discloses a roller having a plurality of radial ports longitudinally spaced and circumferentially spaced on the cover base 21 to supply the pile 20 of the roller.

The Leland patent is one example of a fountain-type paint roller with a supply of paint carried in the roller itself. It is an interchangeable cartridge for a roller handle unit.

The Ritter patent is a reissue of the earlier one mentioned above. The roller of the present application is different from the foregoing in that it employs a stack of core segments and an unusual seal. There is a U.S. Pat. No. 3,230,570 issued Jan. 25, 1966 to Flippen. it uses a stack of annular foam-plastic members 112 to receive and apply paint to a surface such as a parking lot. Another type device using discs is a wet lime marker for athletic fields and the like shown in U.S. Pat. No. 2,778,046 issued Jan. 22, 1957 to A. L. Fisher.

The present invention is directed to providing a roller which contains a minimum quantity of paint and yet evenly distributes it, is reliable in operation, and easily disassembled for cleaning.

SUMMARY OF THE INVENTION

Described briefly, according to a typical embodiment of the invention, a roller core means having a rotational axis has a central cavity therein for receiving a paint supply tube. Bearing means rotatably mount the core means on the shaft and one end of the core means receives the shaft therein. At this location, a combination diaphram and ring seal means provide the seal between the core and the shaft.

DESCRIPTION OF THE PREFERRED EMBODIMENT

Figure 1:
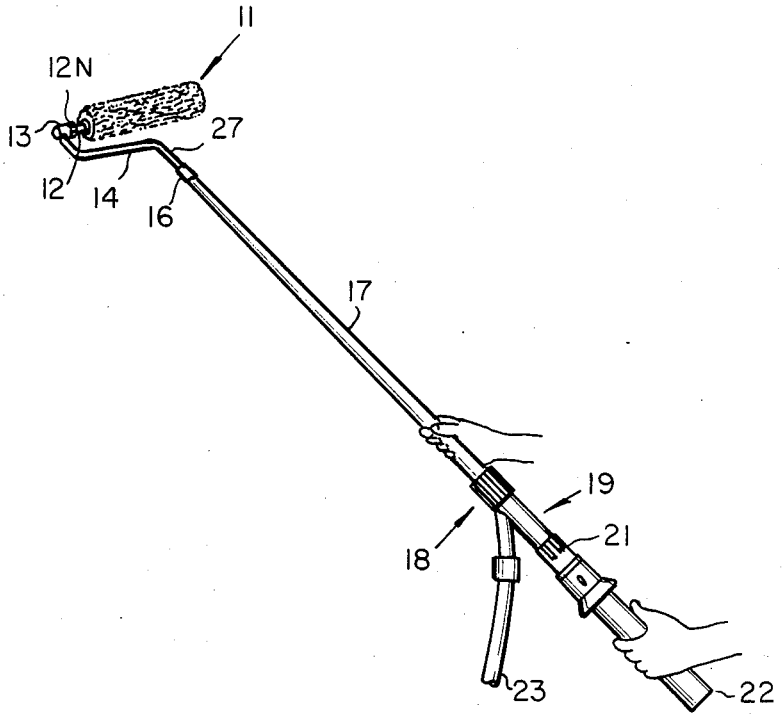
FIG. 1 is a pictorial, in-use, view of a paint roller assembly incorporating the present invention.

For the purposes of promoting an understanding of the principles of the invention, reference will not be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, in FIG. 1 there is a paint roller assembly 11 rotatably mounted on tube 12. Tube 12 has a nut 12N welded on the end which is threaded into the fitting 13. The fitting 13 is mounted at the end of a further tube 14 connected by coupling 16 to a handle extension 17 connected through a further coupling 18 to a swivel connector assembly 19 having a coupling 21 connected to the control handle 22. Paint is supplied under pressure from the hose 23 through the swivel coupling 19, tube 17, tube 14, fitting 13 and tube 12 to the interior of the roller. Apparatus for doing this is disclosed in a patent application of Lawrence B. O'Brien et al., Ser. No. 218,354, filed Dec. 22, 1980, a portion of which is not published in U.S. Pat. No. 4,424,011, issued Jan. 3, 1984.

Figure 2A:
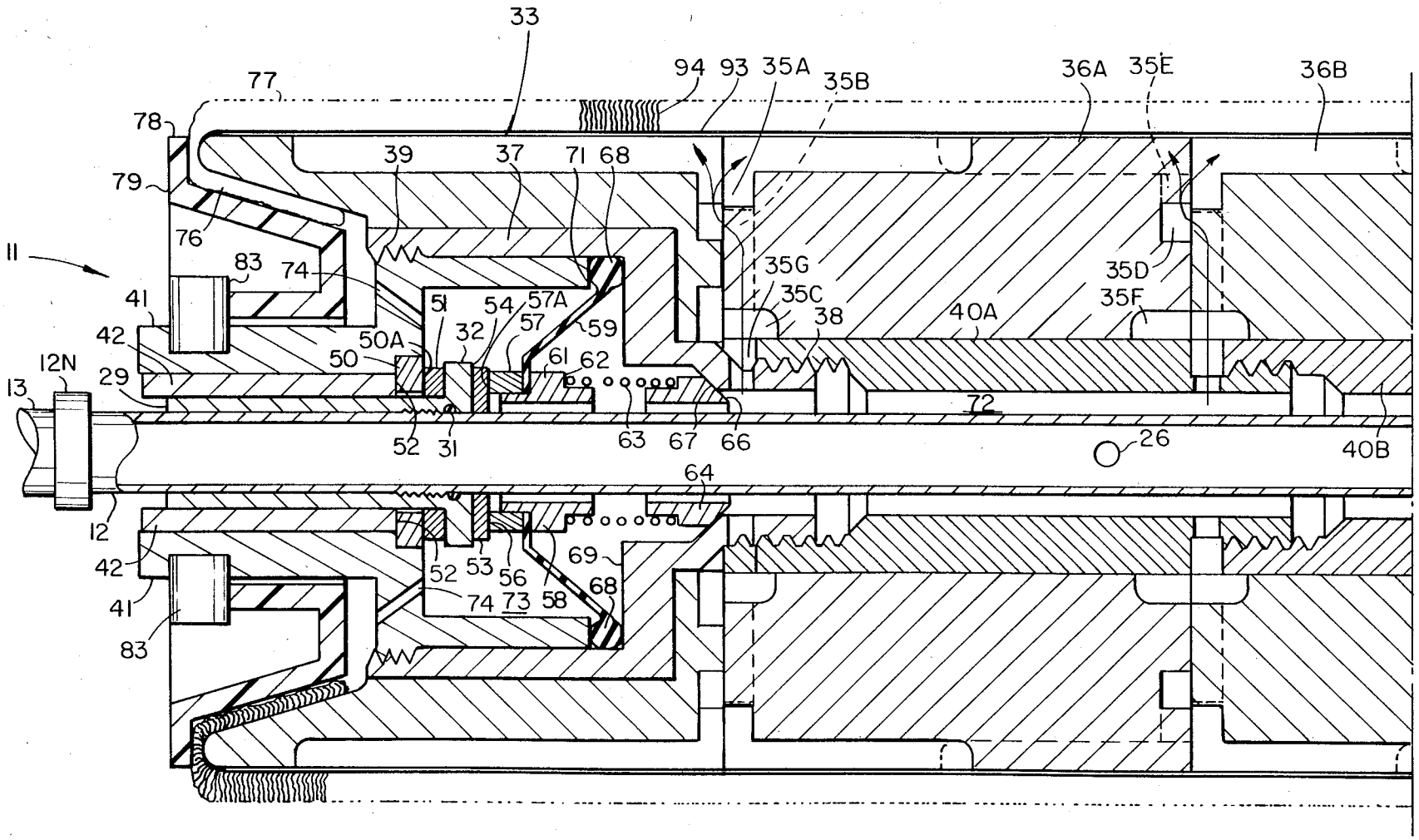
FIG. 2A–2B is a longitudinal sectional view through the roller assembly itself.
Figure 2B:
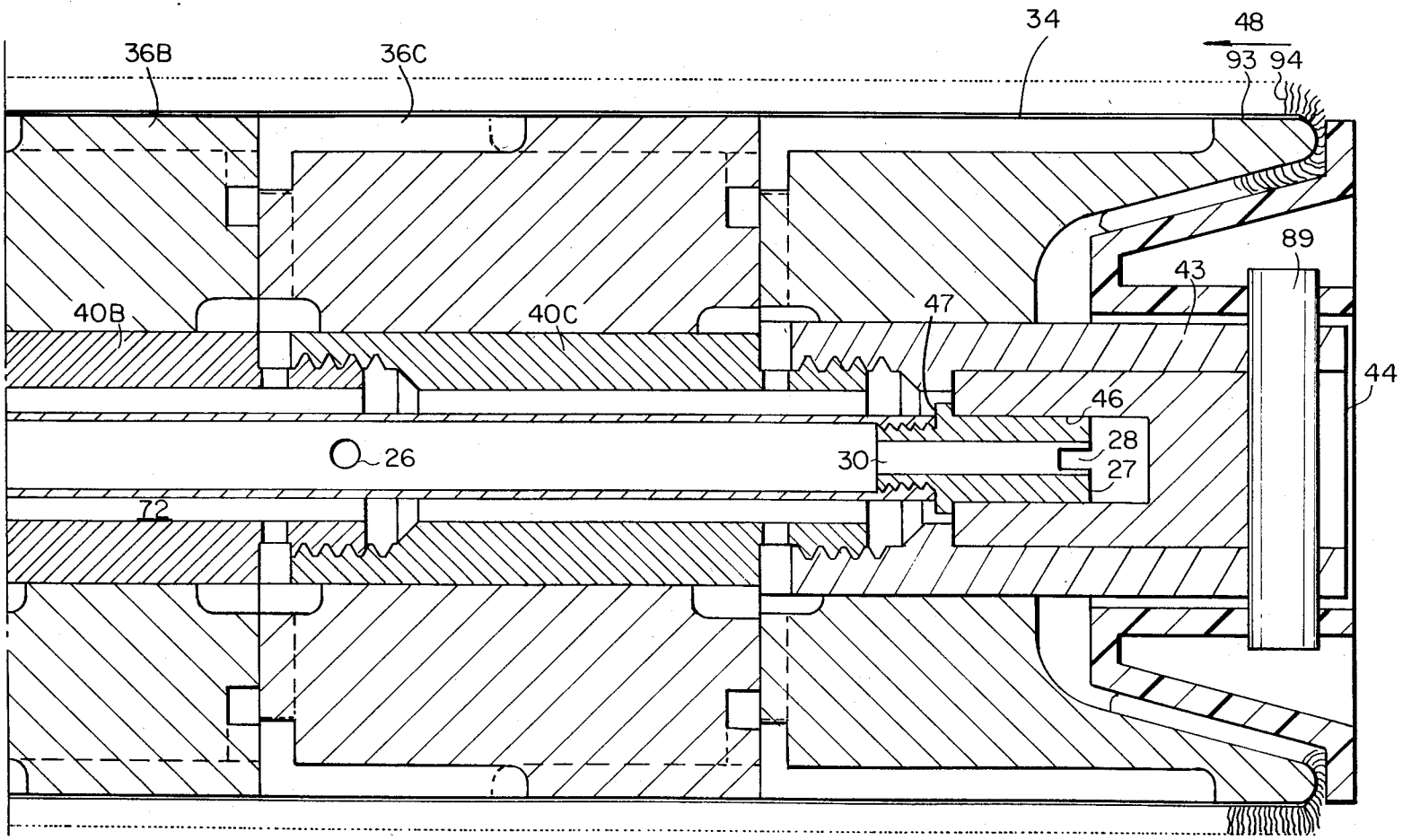

According to a typical embodiment of the present invention, and referring not to FIGS. 2A–2B, it can be seen that the handle tube 12 has two apertures 26 in the wall thereof. While the tube is shown in section, these apertures actually are drilled entirely through, resulting in four aperture in the wall. These dispense paint supplied from the hose 23. Tube 12 is a thick-walled tube and is internally threaded at its distal end. A retainer 27 is threaded into the distal end of tube 12 and, being threaded and having a screwdriver slot 28 therein, is removable for easy servicing of the seal elements, if desired. The retainer is drilled at 30 to allow flushing of paint from the tube 12 during cleaning.

A bushing 29 is secured to the tube 12 by threading onto the tube, and is sealed by an "O" ring 31. Alternatively it could be secured by a set screw received in the flange 32 of the bushing, or secured and sealed by cementing to the tube.

The roller core comprises a stack of segments. Five are shown. More or less could be used. Two end segments are 33 and 34. Three intermediate segments 36A, 36B and 36C are identical to each other. The segments have paint delivery passageways 35A, 35B, 35C, 35D, 35E, 35F and 35G therein. Starting with segment 33, it is made of a solid polyurethane foam material, preferably of approximately a ten pound per cubic foot density. It is secured and sealed on a metal core 37, typically of aluminum or magnesium and which has a threaded boss 38 at its end which is screwed into core 40A of the next segment 36A when the roller is assembled. The segment core 37 has internal threads at 39 at its opposite, outer end. The core 37 is thereby mounted and secured to the retaining nut/bearing member 41 having a bearing 42 secured therein. Member 41 may be made of aluminum while the bearing 42 is preferably made of a molybdenum impregnated nylon "6" material. A product known by the trade name "Nylatron GS" by Polypenco Polymer Corp. of Reading, Pa. can be used. This bearing 42 provides radial bearing support for one end of the roller assembly.

At the distal end of the tube 12, segment 34 is secured and sealed on a metal core member 43 having an end plug 44 therein with a bearing surface 46 therein rotatably received on the radial bearing surface of retainer 27. Although the surface 46 could be received directly on tube 12, the removable and replaceable retainer 27, avoids concern about wear on the tubing 12. The integral flange 47 on the retainer serves to retain on the tube, the seal elements now to be described herein, so they cannot fall off the tube when the roller is disassembled. It also serves to provide a limit of axial movement of the roller on the tube 12 in the direction of arrow 48 toward the proximal end. Since the distal end of the roller assembly is closed, there is no seal provision needed other than to be sure that the segment 34 and plug 44 are properly sealed by glue or otherwise to the core member 43.

The proximal end of the roller assembly is sealed by means which will now be described. A washer 51 is snugly and sealingly received on the bushing 29 and against one face of flange 32. It engages a thrust washer 50 which is snugly and sealingly received in member 41 at a recess in end 52 of bearing 42. This washer 50 should have a hard, wear resistant face 50A. It provides a running seal against washer 51 at this location.

Another washer 53 snugly and sealingly fits tube 12 and sealingly rests against the other face 54 of flange 32. Both washers 51 and 53 may be made of the same low friction, wear resistant material. One example is sold under the trade name "Rulon A" by Dixon Industries, Inc. of Clifton Heights, Pa. Glass filled "Teflon" can also be used for these washers. The flat face 56 of washer 53 provides a running seal against a washer 57 which should also have a hard, wear resistant face 57A. Tungsten cabide has been found to be a suitable material for face 50A of washer 50 and face 57A of washer 57. This washer is secured to a ring 58. A diaphram 59 is sandwiched between and sealed to washer 57 and one face of the flange 61 of the ring 58. As clearly shown in FIG. 2A, there is a clearance between the inside of the ring 58 and the outside of the tube 12, and also, as can be seen, the inner periphery of the diaphragm 59 is spaced radially outwardly from the tube 12. The diaphragm can be made of any material and configuration which is paint resistant and allows free axial movement over a suitable range. Typical materials are rubber, Teflon and metal bellows allowing 0.125 inch axial movement. The other face 62 on flange 61 serves as a spring seat for spring 63. The other end of the spring is seated on the spring seat ring 64. The beveled end 66 of the spring seat ring engages the conical face 67 of the core member 37. Thereby, when segment 33 is screwed onto the member 41, a spring loaded seal is established between the carbide washer 57, the seal ring 53 and the flange 32 of bushing 29. The outer marginal portion of diaphram 59 is formed as thickened rim 68. The rim 68 is clamped between the face 69 of member 37 and the end 71 of member 41. Thereby the end of segment core 37 is sealed when segment 33 is screwed tight onto member 41. It is preferable that, when the roller is assembled, the load applied by spring 63 is five pounds. This is regardless of the area of the seal between washer 53 and ring 57. It has been found that a three pound load is not sufficient to provide the desired sealing function, whereas a seven pound load raises the rotational friction more than desired. Therefore, the paint which is pressurized and in the chamber 72 along the outside of tube 12 and inside the segments of the roller core is prevented from getting out along shaft 12 or otherwise out through the end of the roller. If any seepage occurs past the seal face 56–57, into the chamber 73, the chamber is open to the outside by means of a pressure relief passage 74. In this way, pressure cannot build-up in the chamber 73 and force paint out between bushing 29 and bearing 42. Instead, it will go out toward and be absorbed in the in-folded end 76 of the flexible, sock-like roller cover 77 which is sandwiched between the end of segment 33 and flange 78 of the cover-locking retainer 79. It is possible, through the proper choice of materials and shape of diaphram 59, for the diaphram, when deflected, to apply the necessary sealing force without a separate helical spring. This can be accomplished by molding a spring into a rubber diaphram or constructing a diaphram of metal in a corrugated or bellows shape.

Figure 7:
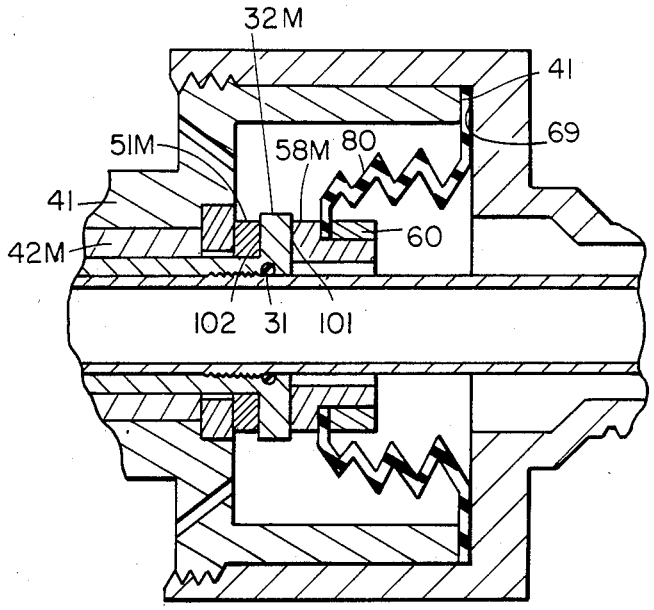
FIG. 7 is a fragmentary view showing an alternate embodiment of the seal assembly.

FIG. 7 shows an embodiment using a spring metal bellows 80 on a modified support ring 58M. In this embodiment, the coil spring 63 and spring seat ring 64 of the previous embodiment are omitted. Also, instead of the hard face washers 50 and 57 of the previous embodiment, the faces 101 and 102 of flange 32M are hard as by carbide facing. Rings 58M and 51M would be made of "Rulon" material, for example, rotate with the roller and cooperate with faces 101 and 102, providing running seals at these locations. A retaining ring 60 on ring 58M aids in the sealing retention of the inner margin of the bellows on support and seal ring 58M. The outer margin of the bellows is secured and sealed between the end 71 of member 41 and face 69 of member 37 when members 41 and 37 are screwed together.

Figure 5:
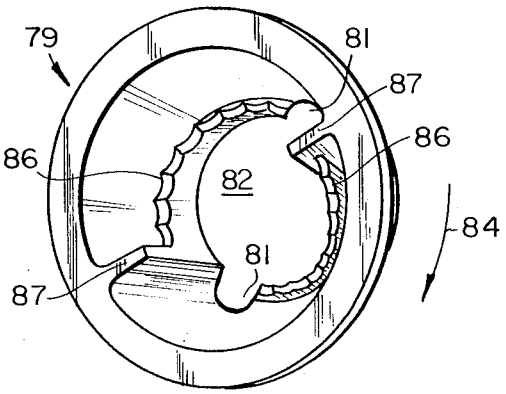
FIG. 5 is a pictorial view of one of the sleeve retainers.

The cover retainer is shown pictorially in FIG. 5. It has two slots 81 projecting radially outward from the central aperture 82 therein. They enable this retainer to be pushed in over the cylindrical pins 83 which are secured in the member 41. Then, by rotating the retainer in the clockwise direction 84, these pins will become engaged with the serrated cam ramps 86. The finger tabs 87 make it easy to turn the retainer clockwise sufficiently to obtain the desired tightness of the cover on the end of segment 33. This adjustment will be maintained by the pins 83 being received in the corresponding notches in the notched ramps. The same construction is provided at the opposite end of the roller assembly, where the retainer is received on the pin 89 which extends entirely through the member 43 and is secured therein. The cover, being sock-like, has a smaller inside diameter than the outside diameter of the core segments. Therefore it must be slid on like a sock on a leg, with slight stretching so that, when secured at the ends, will be snug on all the segments throughout their circumference.

Figure 4:
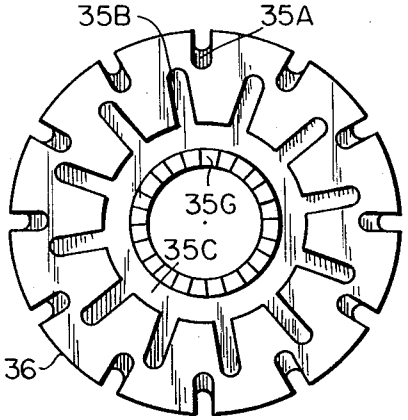
FIG. 4 is a view of the opposite face of one of the roller segments.
Figure 3:
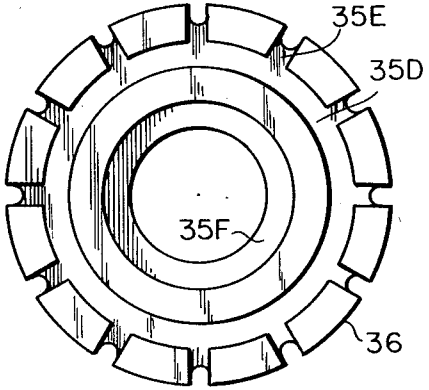
FIG. 3 is a view of one face of one of the roller segments.
Figure 6:
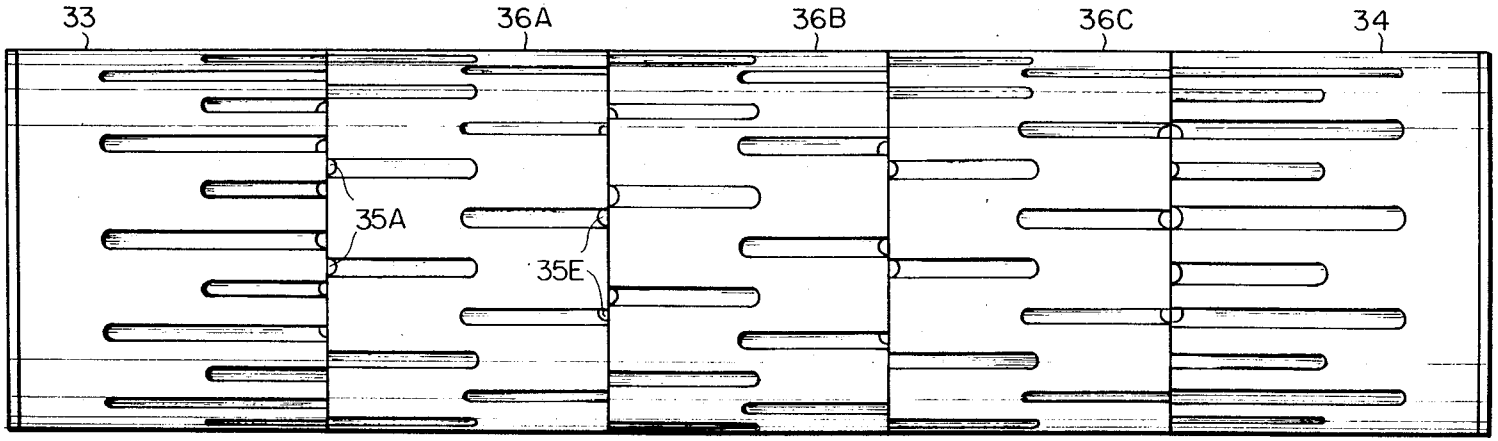
FIG. 6 is a view of the outside of part of the roller assembly, with the shaft and cover omitted.

As shown in FIGS. 3 and 4, the opposite faces of each of the intermediate segments 36 are different. Abutting faces of segments cooperate to provide controlled radial and circumferential flow of the paint from the interior of the segments to the outer surfaces thereof where it can then pass along the longitudinal slots such as shown in FIG. 6 where it is received through the back of a high nap textile roller cover 77. The roller nap material may be any typical high pile knitted fabric manufactured for paint rollers. It is typically knitted polyester backing 93 with a polyester, wool or nylon (or mixed) pile 94 of ¼ inch to 1½ inch height. Flocked foam covers or covers of other materials may be used in some applications.

The roller core of stacked segments features the use of relatively rigid moldable material for segments. This contributes to ease and economy of manufacture, (molded one-piece). Passages can be of any complexity required to achieve required baffling and good distribution. Passages easily open up for cleaning. The use of stacked segments facilitates standardization of components in rollers of different lengths by simply selecting a cover and tube 12 of desired length, and screwing together more or less segments as needed.

It is possible that, in production models, some efficiencies can be achieved in construction. One example would be the possibility of avoiding the necessity of separate metal cores for the segments and, instead, injection molding them with integral external and internal threads. Thereby, instead of having a discrete core such as 40A, for example, with internal threads at one end and external threads at the other end, this would be replaced by the threads being an integral part of and the same material as the grooved portion of the segment. Injection molding could employ either closed cell foam materials, or the segments could be made in two hollow shells, welded together. If foam materials are used for the segments, it is desirable that the type foam and processing be such as to avoid absorption of paint or other materials with which this roller assembly is to be used. If welded shells of non-foam material are used, it is important that the welds be non-leaking, in order to avoid entry of paint under pressure to the cavities in the shell assemblies, and the resulting increase of weight, unbalance, and other problems which would result. Such construction minimizes weight and provides low cost manufacture of a high performance roller.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A paint roller assembly, comprising:

roller core means for rotation about a rotational axis, and having a central cavity extending along said axis;

a paint supply tube extending into said cavity through an open end thereof and along said axis;

bearing means, located at said open end of said cavity, for rotatably mounting said core means on said supply tube;

a stationary seal secured to and encircling said supply tube;

rotating seal means, associated with said core means and encircling said axis, for rotation with said core means and for sealingly engaging said stationary seal;

said stationary seal and said rotating seal means being located in said cavity adjacent but axially inward of said bearing means for preventing paint in said cavity from escaping along the outside of said tube through said bearing means;

a diaphragm having an inner portion encircling but spaced radially outwardly from said supply tube, said inner portion being connected to said rotating seal means and rotatable therewith; and said diaphragm extending radially outwardly from said rotating seal means with an outer periphery of said diaphragm being sealed to said core means, said diaphragm sealing said cavity adjacent said end between said rotating seal means and said core means radially outwardly of said rotating seal means.

2. The assembly of claim 1, wherein said rotating seal means is a first rotating seal means, and further comprising:

second rotating seal means mounted to said core means and facing but axially spaced from said first rotating seal means.

3. The assembly of claim 2 wherein:

said first and second seal means are made of tungsten carbide material.

4. The assembly of claim 2 wherein:

said first and second seal means are made of plastic material.

5. The assembly of claim 4 wherein:

said plastic material is polytetrafluroethylene.

6. The assembly of claim 2 and further comprising:

vent means in said core means located radially outward of said second rotating seal means providing pressure relief to the space between said first and second rotating seal means.

7. The assembly of claim 6 and further comprising:

flexible cover means on said core means.

8. The assembly of claim 2 wherein:

said core means are relatively rigid and closed at one end to contain paint in the cavity therein, said core means have cover means thereon, and said core means have passageway means therein for distribution of paint therethrough from the cavity to the cover means.

9. The assembly of claim 8 wherein:

said second rotating seal means are suitably durable to serve as a thrust bearing means on said core means.

10. The assembly of claim 8, wherein said stationary seal is a first stationary seal, and further comprising:

a second stationary seal associated with and encircling said supply tube;

said first and second stationary seals co-operating respectively with said first and second rotating seal means to provide respectively first and second running seals.

11. The assembly of claim 10 and further comprising:

bushing means secured to said tube and having flange means thereon.

12. The assembly of claim 11 wherein: said flange means has opposite sides providing said first and second stationary seals.

13. The assembly of claim 11 wherein:

said first and second rotating seal means engage opposite sides of said flange means.

14. A paint roller assembly, comprising:

roller core means, having a rotational axis and a central cavity with an open end therein, for receiving a paint supply tube;

first rotating seal means, mounted to said core means and encircling said axis, for sealingly engaging stationary seal means on the paint supply tube when a portion of the tube is received through the open end of said cavity;

a diaphragm attached and sealed to said first rotating seal means and extending radially outward therefrom and sealed to said core means;

second rotating seal means mounted to said core means and facing said first rotating seal means;

vent means, in said core means and located radially outward of said second rotating seal means, for providing pressure relief to a space between said first and second rotating seal means;

a flexible cover on said core means; and said cover extending around an end of said core means and turning inwardly toward an outlet end of said vent means, whereby said cover is in the path of any paint moving radially outward from said vent means on the outside of said core means.

15. A paint roller assembly, comprising:

a roller core having a rotational axis and a central cavity therein in which is received a paint supply tube;

first and second bearing members in said core spaced apart along said axis and rotatably mounting said core to said supply tube;

a first seal ring encircling said supply tube for rotation thereabout;

stationary seal means mounted on said supply tube and having a radially outwardly extending first seal surface sealingly engaged by said first seal ring;

an inner support ring mounted for rotation about said supply tube;

a second seal ring secured to said inner support ring for rotation therewith and sealingly engaging said first seal ring;

a diaphragm attached and sealed to said inner support ring by said second seal ring and extending radially outward from said inner support ring; and a diaphragm outer support ring integral with said diaphragm and sealed to said core, said outer support ring being secured to said core for rotation therewith.

16. The assembly of claim 15 and further comprising:

a third seal ring engaging said first bearing member and a second radially outwardly extending seal surface of said stationary seal means for providing a second seal for the end portion of the core where said diaphragm is located.

17. The assembly of claim 15 and further comprising:

threaded fastener means in said core for clamping said diaphragm outer support ring in said core.

18. The assembly of claim 15 and further comprising:

spring means, between said core and said inner support ring, for urging said second seal ring into said sealing engagement with said first seal ring.

19. The assembly of claim 18 wherein:

said first and second seal rings have flat sealing surfaces engaging each other.

20. The assembly of claim 19 and further comprising:

a bushing sealingly attached to said supply tube and having a radially extending flange thereon; and said first seal ring having a portion sealingly engaged with one face of said flange throughout 360 degrees about said axis, said flange serving to both provide a seal and axial support in one direction against the urging of said spring means.

21. A paint roller assembly, comprising:

a roller core having a rotational axis and a central cavity therealong with an open end;

a paint supply tube, for supplying paint under pressure to said roller core, extending through said open end into and along said central cavity and rotatably supporting said roller core;

a rotating seal mounted in said core and encircling said axis for rotation with said roller core;

a stationary seal mounted on the paint supply tube, said rotating seal sealingly engaging said stationary seal;

a diaphragm attached and sealed around an inner portion to said rotating seal, extending radially outward therefrom, and sealed around an outer portion to said core;

said diaphragm defining two chambers within said roller core, one of said chambers communicating with paint supplied inside said roller core via said paint supply tube, and the other of said chambers communicating with said rotating and stationary seals; and a pressure relief passage in said roller core and located radially outward of said rotating seal, said passage communicating at an inner end with said other chamber and at an outer end externally of said roller core, whereby any paint leakage from between said rotating and stationary seals can escape through said passage and avoid build-up of pressure in said other chamber.

22. The paint roller assembly of claim 21, further comprising a flexible absorbent cover over said roller core, an end of said cover extending around an end of said roller core and being turned radially inwards towards said axis, said turned inwards end of said cover being in the path of any paint leakage escaping out of said outer end of said passage whereby such leakage is absorbed by said cover.

23. A paint roller assembly, comprising:

a roller core having a rotational axis and a central cavity extending along said axis;

a supply tube extending into said cavity along said axis through one end of said core for supplying paint to said cavity;

bearing means, located at said one end, for rotatably mounting said core on said supply tube;

a stationary seal encircling said supply tube adjacent said bearing means, said stationary seal being disposed in said cavity axially inward of said bearing means;

rotating seal means, encircling said supply tube and resiliently biased axially towards said stationary seal, for sealingly engaging said stationary seal and forming a running seal therewith;

said rotating seal means comprising a ring encircling and rotatable about but spaced radially outwardly away from said supply tube with a clearance between said ring and said supply tube;

a diaphragm encircling said supply tube;

a radially outer portion of said diaphragm being secured to said core for rotation therewith;

a radially inner portion of said diaphragm being radially spaced away from said supply tube and connected to said ring for rotation together of said diaphragm and said ring; and said running seal and said diaphragm jointly sealing said cavity at a location adjacent said one end of said core to inhibit the paint supplied to said cavity via said supply tube from penetrating said bearing means.

24. The paint roller assembly of claim 23, further comprising a spring acting between said core and said rotating seal means and resiliently biasing said rotating seal means towards said stationary seal in an axial direction towards said bearing means.

25. The paint roller assembly of claim 24, wherein said ring includes a radially outwardly extending flange, said spring acting upon one side of said flange and said diaphragm engaging an opposite side of said flange.

26. The paint roller assembly of claim 24, wherein said spring loads said rotating seal means against said stationary seal with a force of five pounds.

27. The paint roller assembly of claim 23, wherein said diaphragm comprises a spring metal bellows in which said inner portion is inherently biased resiliently towards said stationary seal.

28. The paint roller assembly of claim 23, wherein said stationary seal comprises a radially extending sealing surface which is engaged by a sealing surface of said rotating seal means.

29. The paint roller assembly of claim 28, wherein said bearing means includes a bushing mounted on said supply tube, and said stationary seal comprises an end flange of said bushing.

30. The paint roller assembly of claim 23, wherein said ring sealingly engages said stationary seal.

31. The paint roller assembly of claim 23, wherein said bearing means includes a member externally screw-threaded and screwed into said core, and said outer portion of said diaphragm is clamped between said member and said core.

* * * * *